United States Patent [19]

Dickens et al.

[11] Patent Number: 4,583,068

[45] Date of Patent: Apr. 15, 1986

[54] LOW PROFILE MAGNETIC STRUCTURE IN WHICH ONE WINDING ACTS AS SUPPORT FOR SECOND WINDING

[75] Inventors: Fredrick T. Dickens, Randolph, N.J.; William A. Peterson, Vestal, N.Y.

[73] Assignee: AT&T Bell Laboratories, Murray Hill, N.J.

[21] Appl. No.: 639,859

[22] Filed: Aug. 13, 1984

[51] Int. Cl.[4] ..... H01F 15/02; H01F 27/30

[52] U.S. Cl. ..... 336/82; 336/83; 336/195; 336/212

[58] Field of Search ..... 336/82, 83, 210, 232, 336/195, 221, 155, 219, 212, 223

[56] References Cited

U.S. PATENT DOCUMENTS

| | | | |
|---|---|---|---|
| 1,199,092 | 9/1916 | Mack | 336/82 |
| 1,908,749 | 5/1933 | Groven | 336/92 |
| 2,553,665 | 5/1951 | McKechnie | 336/82 |
| 3,372,283 | 3/1968 | Jaecklin | 336/155 X |
| 3,602,859 | 8/1971 | Dao | 336/83 |
| 3,859,614 | 1/1975 | Reithmaier | 336/198 X |
| 4,020,439 | 4/1977 | Thiessens et al. | 336/83 X |
| 4,085,347 | 4/1978 | Lichius | 336/219 X |
| 4,134,091 | 1/1979 | Rogers | 336/61 |
| 4,475,097 | 10/1984 | Kikochi | 336/210 X |

FOREIGN PATENT DOCUMENTS

| | | | |
|---|---|---|---|
| 515865 | 1/1928 | Fed. Rep. of Germany | 336/195 |
| 1005638 | 4/1957 | Fed. Rep. of Germany | 336/221 |
| 2012583 | 9/1971 | Fed. Rep. of Germany | 336/210 |
| 42847 | 8/1970 | Finland | 336/82 |
| 1044526 | 10/1966 | United Kingdom | 336/83 |
| 1080320 | 8/1967 | United Kingdom | 336/82 |
| 2035706 | 6/1980 | United Kingdom | 336/83 |

*Primary Examiner*—Thomas J. Kozma
*Attorney, Agent, or Firm*—Alfred G. Steinmetz

[57] ABSTRACT

A low profile magnetic structure comprising E and I type core shapes is dimensioned with the passage length through the core window being very long compared with a cross sectional dimension of the windows. In a transformer design, windings passing through the window are designed to be coaxial with one winding being a shell for the other winding.

5 Claims, 5 Drawing Figures

LOW PROFILE MAGNETIC STRUCTURE IN WHICH ONE WINDING ACTS AS SUPPORT FOR SECOND WINDING

TECHNICAL FIELD

This invention relates to magnetic structures and more particularly to a unique magnetic construction for inductors and transformers. It is related specifically to a very low profile magnetic structure suitable for use in circuit modules adapted for insertion into support structures in close proximity to other circuit modules. It is further specifically concerned with a magnetic structure having satisfactory magnetic performance while minimizing manufacturing effort in its construction.

BACKGROUND OF THE INVENTION

Magnetic devices present many problems to the designer. These problems include space allocations, especially mounted height dimensions, and material costs and its electrical performance. To achieve a desired result in one of these areas usually involves an undesirable compromise to a less desirable result in another area. Two of the most pressing problems at present concern designing magnetic devices that have physical dimensions suitable for modular circuit packs and magnetic devices having acceptable electrical performance while still permitting low cost manufacture.

The present practice of embodying components within circuit modules in a common housing structure requires circuits having low profile dimensions to facilitate their packaging in close proximity to one another in the housing structure where they may all interconnect into a common backplane system. This arrangement has limited the physical size of the magnetic components that may be included in each individual circuit module. These size limitations are particularly critical and difficult to meet in power supply circuit modules which process substantial amounts of power.

Some prior arrangements to adapt magnetic structures to meet low profile requirements have included using air core magnetic devices with the conductor printed in a spiral format on the circuit board of the module. In some arrangements a magnetic material has been additionally deposited on the circuit board in close proximity with the printed conductor windings. In terms of operational efficiency, flux containment and control of parasitics, these arrangements have had limited success. However, the advantage of low profile and ease of manufacture has in many instances dictated their use. One particular example of a different type of a low profile magnetic structure is disclosed in U.S. Pat. No. 4,134,091 issued to N. A. Rogers on Jan. 9, 1979. The structure disclosed therein consists of a plurality of toroidal cores which are strung in bead-like fashion on the transformer windings. The transformer windings are preferably coaxial with one of the windings comprising electrically conductive tubing to support or contain the other windings. While a low profile is achieved, the transformer assembly is loosely structured and very expensive to manufacture. Hence, a magnetic structure retaining the advantage of easily automated manufacture and low profile combined with the further advantage of well defined flux paths, low parasitics and efficiency is very desirable.

SUMMARY OF THE INVENTION

A new magnetic structure embodying the principles of the invention is constructed with E-I or E-E cores of composite material or of sheet laminations dimensioned with the passage length through the windows in the core being very long compared with the cross sectional side dimensions of each window of the core so that an extremely low profile magnetic structure in a given power range may be obtained. In the case of a transformer, the core windings passing through these windows are designed to be coaxial, (i.e., one winding within the other) to increase interaction between the two windings and thereby reduce leakage inductance. One winding is designed in the form of a shell with a channel cross section and allows an optional cover arrangement in which the composite shell encloses the other winding. The shell winding may be designed to act as a bobbin for the other winding. The optional cover allows completion of the coaxial enclosure of the one winding over the other.

This magnetic structure has a relatively high power density and a low profile permitting its use on circuit modules and boards that are stacked or positioned close to one another in a housing structure. The nature of the magnetic structure is also effective in retaining flux; and hence, significantly reduces parasitics compared to other low profile magnetic structures.

An advantage of this magnetic structure is the ease of construction and assembly of the completed magnetic device as permitted by the design of its component parts. Each individual part is manufactured separately and final assembly involves inserting and assembling individual components in place in a simple sequence and affixing the completed assemblies to the circuit module.

BRIEF DESCRIPTION OF THE DRAWING

An understanding of the invention may be readily attained by reference to the following specification and accompanying drawings in which.

DETAILED DESCRIPTION

Figure 1:
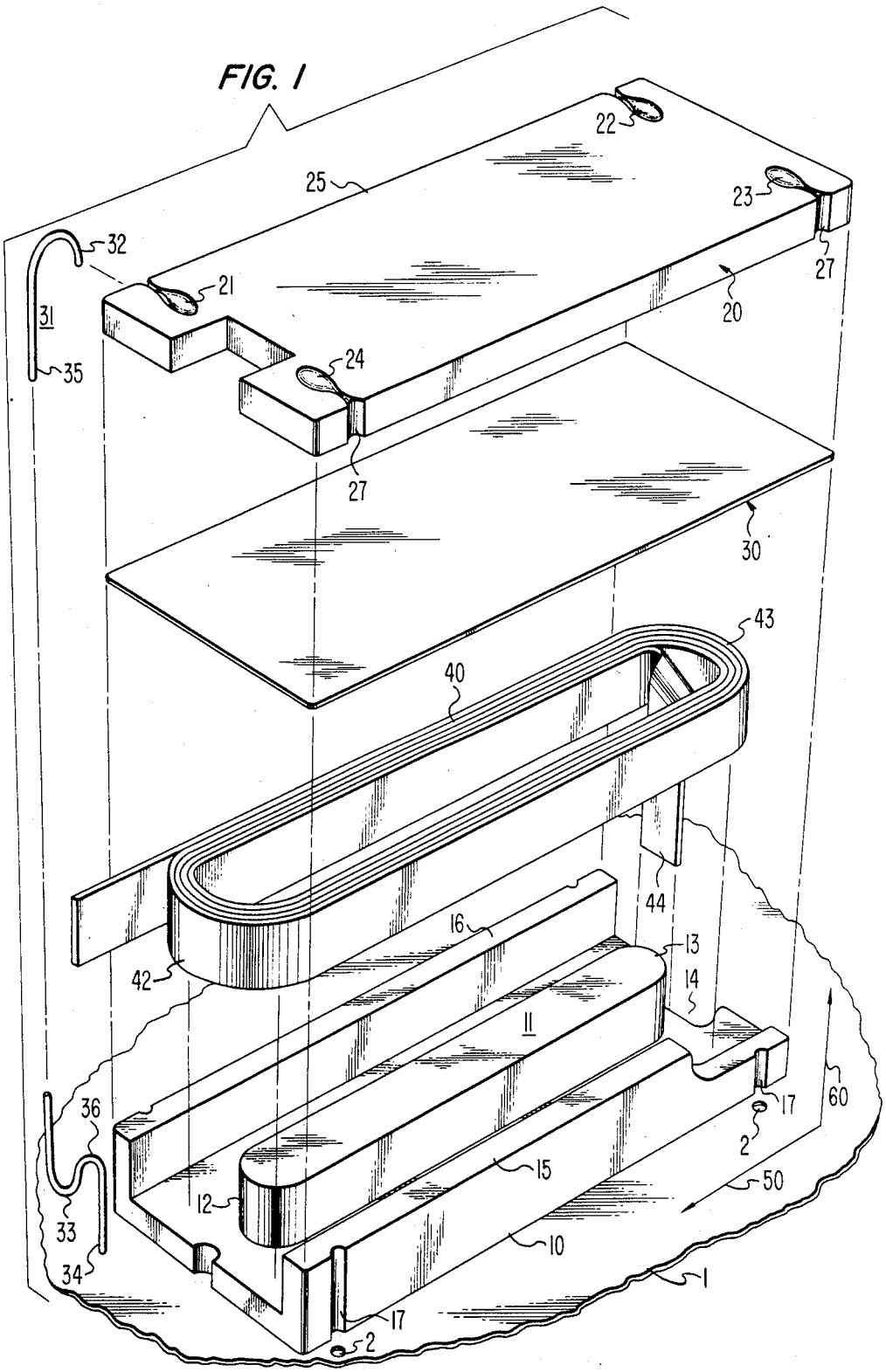
FIG. 1 shows in an exploded perspective view an exemplary embodiment of an inductor structure including an optional air gap spacer and embodying the principles of the invention.

The magnetic structure shown in an exploded perspective view in FIG. 1, is a low profile inductive type magnetic structure including an E core component 10 of magnetic material, an I core component 20 of magnetic material, and a spacer 30 of nonmagnetic material used to maintain an air gap between the E and I components. While an air gap spacer is disclosed, a suitable air gap may be obtained by shortening the center leg 11 in the direction of axis 60 as compared with the height of the two outer legs 15 and 16 in the direction of axis 60.

The inductor winding 40 is constructed of a multiturn ribbon conductor and is formed to fit around the center leg 11 of the E core component 10. Both the E and I core components 10 and 20 are shown in FIG. 1 and in some subsequent figures as solidly constructed components of a composite ferrite material having a high electrical resistivity to limit eddy currents. These cores are formed by die pressing techniques well known to those skilled in the magnetic core construction art; and hence, they need not be discussed herein in detail.

As shown in FIG. 1 the center core leg 11 has rounded ends 12 and 13 which match the rounded end curves 42 and 43 of the ribbon conductor 40. A cut away aperture 14 at one end of the core 10 allows a lead 44 of the ribbon conductor 40 access to the circuit board on which the magnetic structure is mounted. The center core leg 11 is shorter in length along a horizontal axis 50 as shown in FIG. 1 than the length of the two outer core legs 15 and 16 along horizontal axis 50. Core legs 15 and 16, as shown, have a length equalling the full length of the magnetic structure. The three core legs 11, 15 and 16 may have a uniform height dimension if an air gap spacer 30 is used, and hence, their top surfaces all lie on the same plane. If an air gap spacer is not used, a suitable air gap may be obtained as indicated above by shortening the length of the center leg 11 along the vertical axis 60, as shown in FIG. 1, relative to the vertical axis lengths of the two outer legs 15 and 16. In the embodiment shown in FIG. 1, the air gap spacer 30 and the I core component 20 in that order sit on top of the equiplanar top surface of the three core legs 11, 15 and 16 to complete the inductor structure. The air gap spacer 30 is constructed of a nonmagnetic material and is dimensioned to supply the proper air gap to secure the desired inductance value.

The magnetic structure comprising the core components 10 and 20 and spacer 30 is held together by clip devices 31 of which one clip is shown at detent 21 of the I core section 20. These clip devices 31 are positioned in the disclosed embodiment at the four corners of the E and I components 10 and 20 of the magnetic structure. The clips 31 each comprise an open hook structure 32 at one end, and an S shaped hook 33 at the other end which includes a long prong 34 to engage receptacles 2 in register therewith in the circuit board or support chassis 1 so the magnetic structure may be secured thereto.

The I core component 20 includes four detents 21, 22, 23 and 24 having an oval-like shape cut into its top surface 25. One connecting clip device 31 is associated with each detent although only one clip is shown in FIG. 1. The open hook end 32 of each clip is hooked into one of the detents 21, 22, 23, or 24. The body or straight pin portion 35 of the clip device 31 fits into the grooves or channels 27 and 17 cut into sides of both the I and E core components 20 and 10; respectively, the bottom point 36 of the S hook shape 33 hooks into corresponding detents (not shown in FIG. 1) located on the bottom mounting surface of the E core component 10. The magnetic structure is secured to the circuit board 1 by inserting and soldering the pin or prong end 34 of the clip 31 into corresponding receptacle holes 2 located in the circuit board 1. The detents of both E and I cores 10 and 20 are located at the extreme ends of the structure so as to be outside of the main flux path linking the inductor winding 40.

Figure 4:
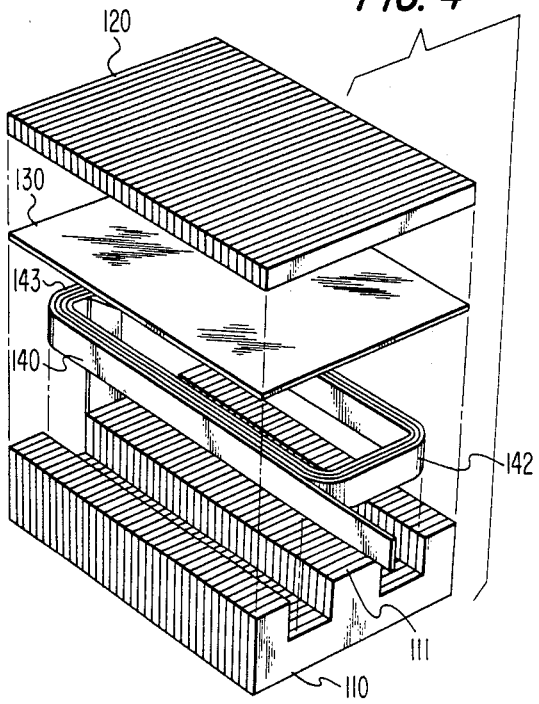
FIG. 4 shows in an exploded perspective view an inductor core structure suitable for sheet lamination construction with magnetic sheet material.

An alternative inductor core construction is shown in FIG. 4. This particular structural embodiment of the invention is more readily adapted to laminated sheet construction of the cores. The ends of the E and I core components 110 and 120, respectively, are rectangular and square as compared with the core structure in FIG. 1. The center core leg 111; in particular, is squared off to permit easy laminate type construction using sheet laminate magnetic materials. The sole inductive winding 140 comprises a single ribbon conductor which is squared off at the ends 142 and 143 to accommodate the rectangular shape of the center core leg 111 of the E core structure 110. Cores 110 and 120 are separated by an air gap spacer 130. A suitable air gap may be attained, as described above, by making the center leg 111 shorter than the two outer legs.

Due to the high aspect ratio of window passage length to the cross sectional length and width of windows of the magnetic structure of FIG. 4, the preferred method of securing the sheet laminations to each other is to construct the structure with preglued stacks of sheet laminates. Since the detents could not easily be created in a laminated structure, the preferred method of securing the structure to a circuit board would be through using traditional clamping techniques.

Figure 2:
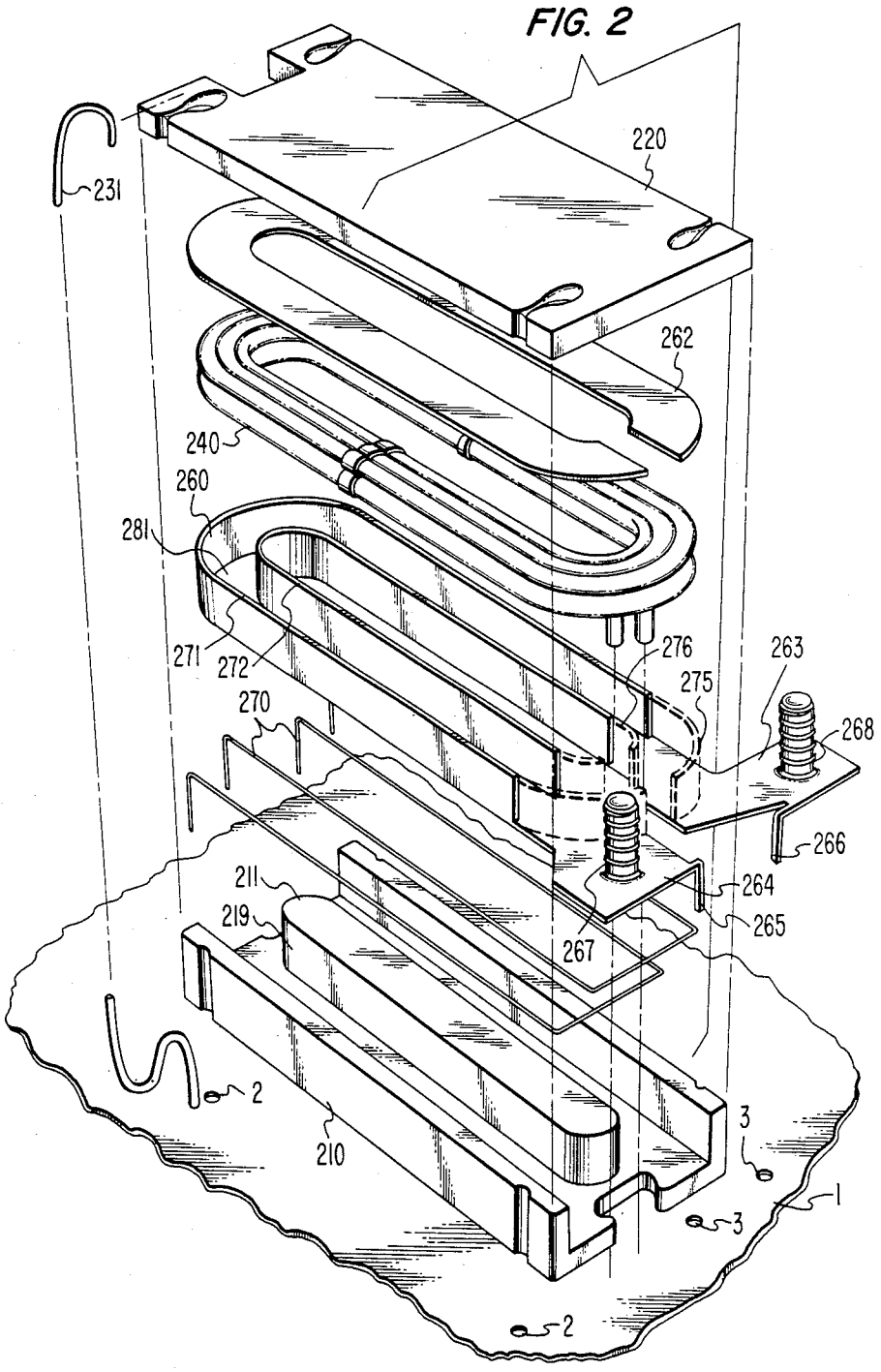
FIG. 2 shows in an exploded perspective view an exemplary embodiment of a transformer structure embodying the principles of the invention.

A low profile transformer structure is shown in an exploded perspective view in FIG. 2 and includes an I core component 220, an E core component 210, first and second windings 240 and 260, which may represent primary and secondary windings and a tertiary winding arrangement 270 which may represent a bias winding. The E and I core components 210 and 220 are substantially the same as the core components 10 and 20 of the inductor structure shown in FIG. 1. The method of securing the structure together and securing it to the circuit board 1 uses clip 231 in exactly the same manner as was described above with respect to the inductor structure of FIG. 1.

The transformer structure of FIG. 2 includes both primary and secondary windings 240 and 260; respectively, and additionally includes the tertiary windings 270, all of which are wound or constructed around the center leg 211 of the E core component 210. The secondary winding 260 is constructed in the form of a shell having a channel cross section with a matching plate cover 262 to enclose the channel. The primary winding 240 is wound or constructed so it fits inside the channel or shell formed by secondary winding 260, whereby the primary and secondary windings 240 and 260 are coaxial with each other.

The primary winding 240 may, as shown, comprise a circular conductor wound or formed as shown or it may comprise a wound ribbon conductor such as was disclosed in FIG. 1 in describing the inductor construction. The shell portion of the secondary winding 260 has channel sides 271 and 272 shown parallel to the sides 219 of the center leg 211 and which end before the primary winding 240 bends at the end in order to facilitate its manufacture. The base of the channel 281 is as shown perpendicular to the sides of the center leg 211. It may be desirable in some situations to improve coupling of the two windings 240 and 260 by extending the shell sides around this bend as shown by dotted lines 275 and 276.

If very close coupling is desired, a conductive cover 262 is placed on top of the channel and secured thereto by glue or solder so that the two windings are coaxial. This cover may be left off to facilitate assembly of the transformer if desired. The cover, if added, must be conductively connected to the shell at the end near terminal plates 263 and 264 to achieve the low leakage inductance benefits of the coaxial configuration. The shell as indicated may, if desired, be used without the cover 262; however, the leakage inductance will be increased over a similar design using the cover. The shell of the secondary winding 260 is shaped to essentially conform to the outside perimeter of the center core leg 211 of the E type core component 210. The channel structure of winding 260 is split at one end with flat plates 263 and 264; respectively, extending from each of the split ends. Prongs 265 and 266 are formed at the end of each flat plate and are designed to fit into electrical receptacles and/or mechanical securing receptacles 3 in the circuit board 1 for voltage sensing or mechanical connection purposes. The treaded studs 267 and 268 allow the connection of electrical circuitry to the winding 260.

Positioned beneath the shell are tertiary or bias windings 270 comprising thin inserted copper leads. The bias windings may comprise single (as shown) or multiple turns and are located at the bottom of the window beneath the secondary shell windings. These bias windings have a thin cross section permitted by their low power carrying requirements; and hence, they do not add significantly to the height dimension required of the window of the structure; and hence, do not detract from the low profile requirements. While the tertiary windings 270 are shown positioned outside the shell winding 260, it is to be understood that they could be included inside the shell if tight coupling is desired.

The transformer structure shown in FIG. 2 may be constructed in laminated form, as was the case with the inductor structure of FIG. 1 shown in laminated form in FIG. 4. The shell and primary winding would be similarly squared at the end to accommodate the square form of the center leg of the E core component construction. As in the case of the laminated inductor in FIG. 4, the sheet laminates would be preglued together and the transformer structure would be clamped to the circuit module.

Figure 3:
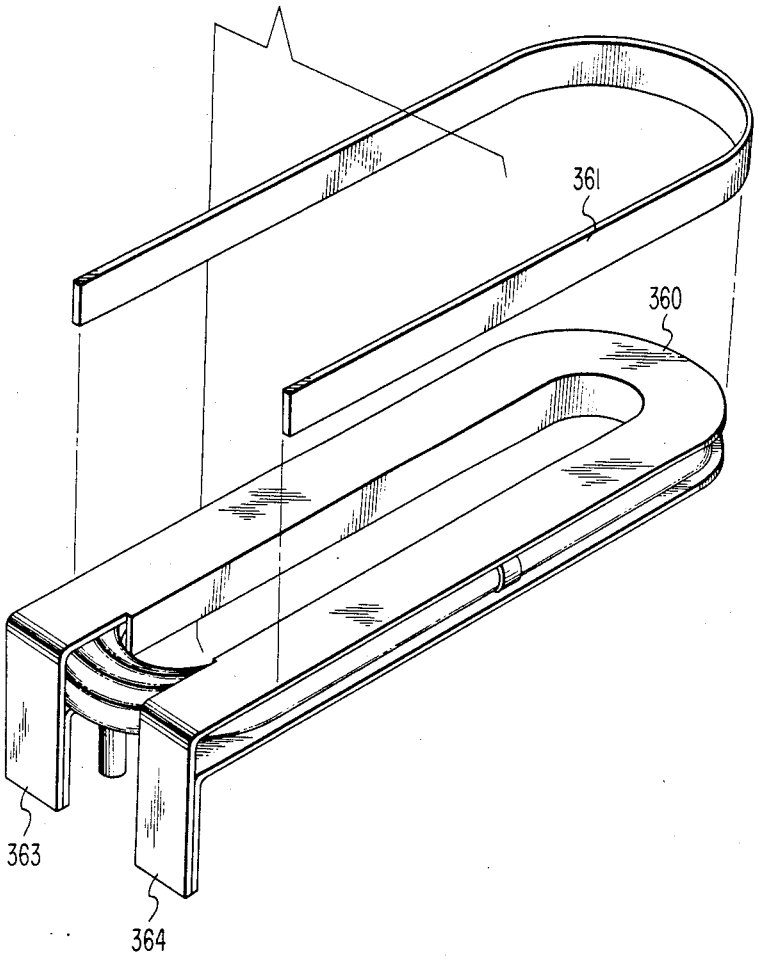
FIG. 3 shows in an exploded perspective view an alternative winding construction for the transformer of FIG. 2.

An alternate winding form for the transformer of FIG. 2 is shown in FIG. 3. The shell 360 which may comprise a primary or secondary winding is constructed with a channel cross section having open sides around the outer periphery so that it resembles a bobbin-type structure. This arrangement permits the other winding to be wound about it as with a conventional bobbin. The cover 361 is appropriately shaped to close the open side of the shell channel. The ends of the shell include prongs 363 and 364, which are bent, as shown, after the bobbin is wound. The prongs are then connected to corresponding receptacles within the circuit board and secured thereto.

While the shell winding in FIGS. 2 and 3 has been described herein as a secondary winding, it is readily apparent to those skilled in the art that it could also be the primary winding and the multiple turn winding, the secondary winding. It is preferable that the low voltage winding be constructed from the shell conductor.

A 300 watt transformer, embodying the principles of the invention, such as shown in FIG. 2 would have overall core dimensions as assembled with an overall length of 3 inches, a width of 1.25 inches and an overall height of 0.625 inches which is substantially smaller than the length or width dimension. Each window has a width of 0.32 inches and a height of 0.32 inches with a window length or through distance of approximately 2.5 inches, which is the length of the center leg. Hence, the window length or distance through the window substantially exceeds its cross dimensions by a ratio of 8:1. The overall length exceeds overall width by a ratio of 2.5:1 and exceeds its height by a ratio of 4.8:1. A low profile concept in accordance with the invention, however, is not strictly limited to these specific dimensions.

Figure 5:
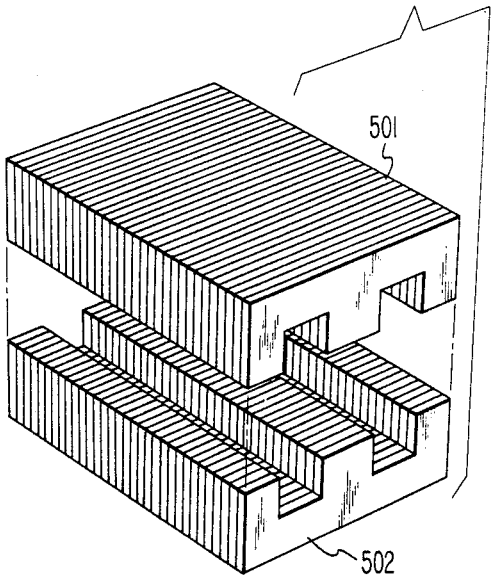
FIG. 5 shows in perspective view another core structure arrangement suitable for inductor or transformer structures.

An alternate core construction form is shown in FIG. 5 wherein a magnetic structure is shown comprising two E core component shapes 501 and 502 designed to have their individual leg ends substantially abutted together. The particular core shape shown is suitable for construction in both the composition as used with the examples of FIGS. 1 and 2 and also laminated form, as used with the examples of FIG. 4. The particular form shown in FIG. 5 is laminated; however, the composition form is equally suitable.

What is claimed is:

1. In combination:

a circuit support chassis for supporting circuit components and including pin receptacle means, a transformer structure comprising:

an E shaped core component defining first and second winding containing windows, each window having a length dimension substantially exceeding its width and height dimension, and being separated from each other by a center leg of the E shaped core;

a first winding constructed of a conductive material and having a channel cross section, and positioned to encircle the center leg of the E shaped core and having a base of the channel cross section perpendicular to sidewalls of the center leg and two sides of the channel cross section being parallel to sidewalls of the center leg and having an open side facing upward in a same direction as an open side of the windows defined by the E shaped core component;

a second winding placed within the channel cross section shape of the first winding;

a conductive cover forming a part of the first winding and placed on top of the channel cross section to fully enclose the channel cross section and make the first and second windings substantially coaxial;

an I shaped core component having a length along the first and second windows substantially longer than a width across the first and second windows and placed on ends of legs of the E shaped core component to complete a magnetic path therewith;

a bottom surface of the E shaped core component further including detents at its corners and a top surface of the I shaped core component further including detents at its corners, and a plurality of clip devices each including first and second hook terminations to fit into the detents and connected thereto for securing the E shaped core component and the I shaped core component together, each clip further including pins which fit into the pin receptacle means to secure the transformer structure to the circuit support chassis.

2. A combination as defined in claim 1 wherein a transformer structure formed by assembly of the E core component and the I core component has a length dimension exceeding its height dimension by a ratio of 4:1 and a width dimension exceeding its height by a ratio of 2:1 and each window having a length dimension exceeding any of its cross sectional dimensions by a ratio of at least 7:1.

3. A magnetic structure comprising:

a first magnetic core component having an E cross sectional shape, a second magnetic core component having a rectangular cross sectional shape and designed to mate with the first core component to create two windows for accepting windings, the two windows having a through dimension greatly exceeding any of its cross section dimensions, a first winding having a channel cross section passing continuously through the two windows, a second winding placed within the channel cross section of the first winding, a center core leg of the first magnetic core component being shorter along the through dimension than outer core legs of the first magnetic core component so that the first and second windings are contained between a base of the first magnetic core component and the second magnetic component, and fastening means for securing the first and second magnetic core components together and including means for securing the magnetic structure to a circuit chassis.

4. A magnetic structure as defined in claim 3 wherein the fastening means include a plurality of clip devices each including hook ends and a bottom mounting surface of the first magnetic core component and a top surface of the second magnetic core component including detents at corners for engaging the hook ends of the clip devices, and the means for securing of the clip devices each including prongs at one end for engaging receptacles in a circuit chassis.

5. A magnetic structure as defined in claim 3 and further including a conductive cover for enclosing the channel cross section of the first winding, whereby the first and second windings are coaxial to each other.

* * * * *